US007637224B1

(12) United States Patent
Portmann et al.

(10) Patent No.: US 7,637,224 B1
(45) Date of Patent: Dec. 29, 2009

(54) COMMAND INFLATABLE BOAT STOPPING BARRIER

(75) Inventors: Helmut Portmann, Panama City Beach, FL (US); Elan Moritz, Lynn Haven, FL (US); David Everhart, Panama City, FL (US); Ronald Swart, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/214,920

(22) Filed: Jun. 20, 2008

(51) Int. Cl.
*B63B 7/00* (2006.01)

(52) U.S. Cl. ..... 114/345; 114/240 D; 114/267; 405/66; 405/68

(58) Field of Classification Search ..... 114/240 A, 114/240 D, 264, 267, 345; 210/776; 405/66, 405/68, 69, 70, 72, 63
See application file for complete search history.

(56) References Cited

U.S. PATENT DOCUMENTS 3,664,504 A * 5/1972 Ayers et al. ..... 210/776
4,104,884 A * 8/1978 Preus ..... 405/68
4,573,426 A * 3/1986 Larsson ..... 405/68
6,767,162 B2 * 7/2004 Meyers et al. ..... 405/23

* cited by examiner

*Primary Examiner*—Lars A Olson
(74) *Attorney, Agent, or Firm*—James T. Shepherd

(57) ABSTRACT

An inflatable barrier system halts an approaching boat. A barrier support platform houses a pressurized gas source and a power supply and has a winch connected to a pair of cables. An inflatable barrier body member having a bow and stern is coupled to the pressurized gas source for inflation of the body member and the cables are connected to the bow and stern to deploy the inflated body member at the surface of the water and to maintain the bow above the surface and the stern below the surface of the water. A barrier controller provides signals indicative of the approaching boat to initiate the inflation of the inflatable barrier body member and the deployment of the inflated barrier body member at the surface with the bow above the surface and the stern below the surface without inflicting excessive damage to the boat or injury to its occupants.

16 Claims, 6 Drawing Sheets

COMMAND INFLATABLE BOAT STOPPING BARRIER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention is for a quickly deployable barrier for boats. More particularly, this invention provides a non-visible, submerged ramp-shaped flotation barrier selectably released and inflated to non-lethally and non-destructively divert or stop forward progress and navigability of boats to secure an area.

Usually manned patrol craft or aircraft are sent to intercept potentially hostile boats or small water craft intruding in a restricted water area. To be successful, however, the boat or small craft must be willing to stop for closer inspection; if this isn't accomplished, the intercepting craft would have to use destructive force to engage the intruder with the danger of receiving hostile fire in return.

To reduce the hazard of friendly damage and casualties, a variety of floating barriers also have evolved to stop fast moving boats in restricted areas of water. A common approach for many barriers is to string out lengths of light weight but resilient materials such as plastic and foam. Typical examples of components and arrangements for these and other more effective barriers can be made from a series of discrete floats linked together by lines or cables. Exemplary arrangements of linked together floats and lines are being marketed as Armorfloat™ Floating Barrier Systems, see [http://armorfloat.com/]; as the SEABARRIER, see [http://www.seaward.com/products/floating-barriets/seabarrier/index.html]; and as the Small Standard Duty SEA CUSHION Marine Fenders that are made of solid foam construction with high Filament-reinforced skin in order to survive without going flat if punctured.

Another barrier design calls for establishing a perimeter fence that can absorb the impact of a fast moving boat. For example, the port security barrier system of U.S. Pat. No. 6,681,709 utilizes a continuous modular, floating barrier installed in lengths ranging from a few hundred feet to over a mile. This floating barrier is made up of a plurality of modular net structures connected to one another to form a floating security fence supported by a plurality of mooring buoys. Another similar barrier is the harbor fence disclosed in U.S. Pat. No. 7,233,544 that is designed to be deployed in water around ships or other waterfront structures. This harbor fence has a series of spars that protrude above the water surface and are connected with an electrical computer to a telemetry subsystem. Still another related design that is said to provide controllable access to an otherwise protected area is the fence-like harbor protection apparatus of U.S. Patent Application Publication US 2006/021616A1. Side-by-side floating barrier units support nets above the water to protect an area of a body of water from waterborne craft. A gate is included to allow the craft to access or egress the protected area. Finally, there's the DUNLOP Ship Fender Barrier. The barriers made by Dunlop Inc., are inflated cylinders of a rubber-coated textile, measuring eighty-two-feet long by eight-feet in diameter. They are linked together or to a mooring buoy.

All of these contemporary barrier structures are stationary structures that float on the water in the open and are highly visible from afar. Consequently, they can be easily seen and present a target that can be neutralized or breached by explosives or bypassed by a high speed maneuverable boat.

Thus, in accordance with this inventive concept, a need has been recognized in the state of the art for a quickly deployable barrier system having a non-visible, submerged ramp-shaped flotation barrier body member automatically and/or observer released and inflated to divert or stop high speed boats from protected areas of water.

SUMMARY OF THE INVENTION

The present invention provides an inflatable barrier system capable of diverting an approaching boat without inflicting excessive damage to the boat or injury to its occupants. A barrier support platform houses a pressurized gas source and a power supply and has a winch connected to a pair of cables. An inflatable barrier body member having a bow and stern is coupled to the pressurized gas source for inflation of the body member, and the cables are connected to the bow and stern to deploy the inflated body member at the surface of the water and to maintain the bow above the surface and the stern below the surface of the water. A barrier controller provides signals indicative of the approaching boat to initiate the inflation of the inflatable barrier body member and the deployment of the inflated barrier body member at the surface with the bow above the surface and the stern below the surface. An acoustic modem/signal receiver is also housed in the support platform and is responsive to the signals indicative of the approaching boat on the water's surface. Control electronics are also housed in the support platform and are responsive to the acoustic modem/signal receiver to actuate the gas source and the winch. The inflatable barrier body member has an inflatable chamber and is wedge shaped when the chamber is inflated by pressurized gas. A deflating valve is connected to the body member to allow its selective deflation and a one-way inflation valve fitting is connected to the body member to receive and pass pressurized gas from the pressurized gas source to the inflatable chamber. The body member has tough flexible walls of a heavy-duty laminate structure enclosing an inflatable chamber. A topside surface layer of thick, tough, rough textured material is disposed on the body member and has a very high friction coefficient to arrest forward progress and to keep the broached boat from sliding backward off the inflated body member.

An object of the invention is to provide an inflatable barrier system having a wedge-shaped inflatable barrier body member to divert/stop motion of a boat.

Another object of the invention is to provide a non-visible ramp-shaped inflatable barrier that is retained below the surface of the water and is capable of being rapidly inflated and deployed to the water/air interface to divert/stop boats.

Another object of the invention is to provide an inflatable barrier system activated by an observer and/or sensing device responsive to an approaching boat to inflate a deflated barrier body member beneath the surface of the water to create a wedge-shaped inflated barrier body member at the water/air interface.

Another object of the invention is to provide an inflatable barrier system having a ramp-shaped inflatable barrier body member to divert/stop motion of a boat with low impact to reduce the possibility of boat damage and/or injury to its occupants.

These and other objects of the invention will become more readily apparent from the ensuing specification when taken in conjunction with the appended claims.

DESCRIPTION OF THE PREFERRED EMBODIMENT

Figure 1:
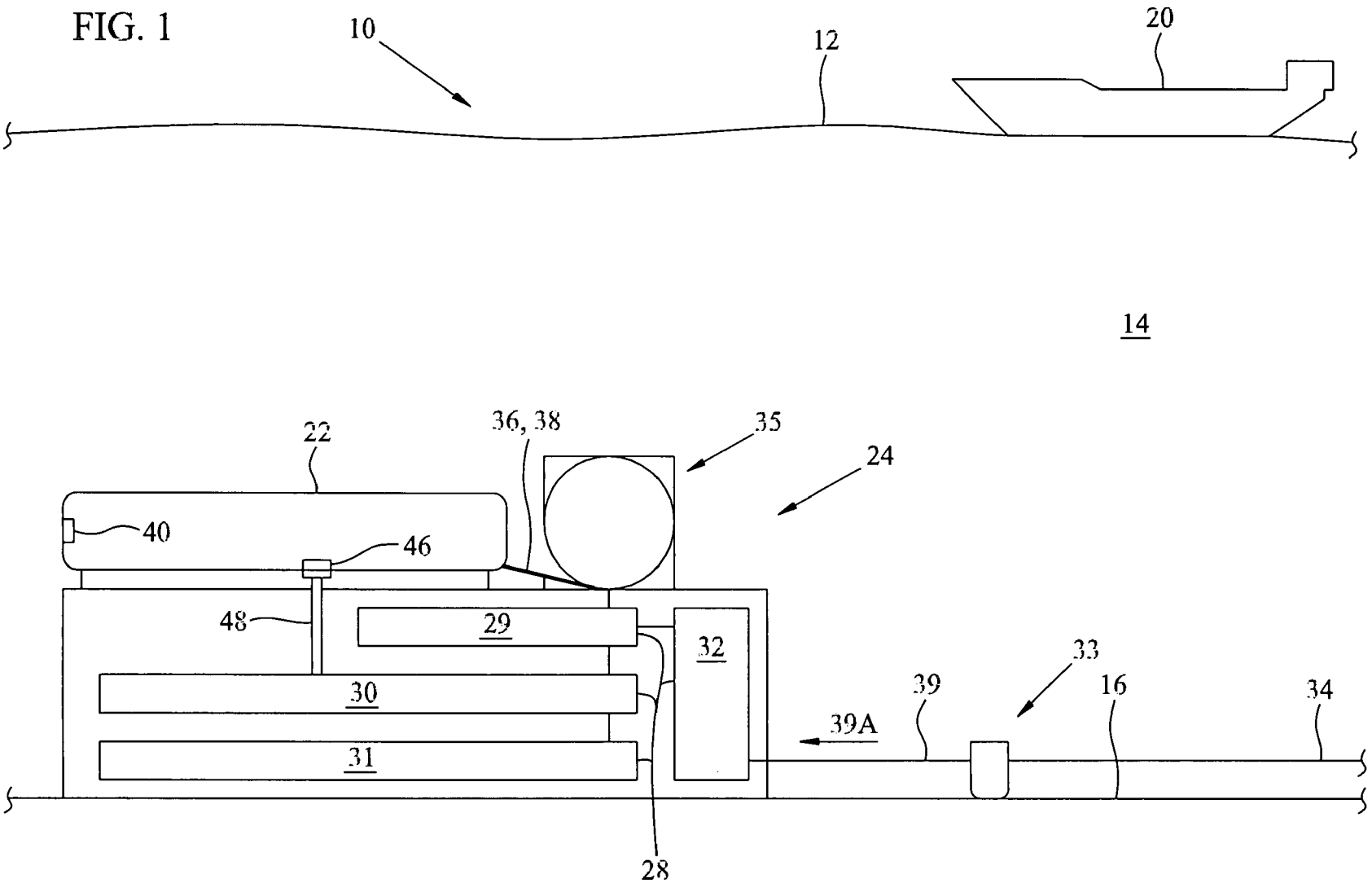
FIG. 1 is a schematic side view of the inflatable barrier system of the invention detailing the major components thereof and showing a deflated barrier body member on the barrier support platform on the bottom of a body of water prior to deployment.

Referring to FIG. 1, an inflatable barrier system 10 of the invention is submerged below the surface 12 of a body of water 14 on the bottom 16. Alternatively, the system can be moored above the bottom while remaining concealed below surface 12. Barrier system 10, therefore, is hidden from view by personnel on an approaching boat or other small craft 20 until a flexible inflatable barrier body member 22 is inflated on a barrier support platform 24 and is deployed to surface 12 to arrest the motion of boat 20.

Barrier support platform 24 preferably has a heavy duty metal construction that may be additionally negatively ballasted to function as a heavy sea anchor-enclosure or housing for barrier system 10 that holds it on the bottom when inflatable barrier body member 22 on platform 24 is inflated. The robust construction of platform 24 allows it to be quickly placed on bottom 16 at short notice by expeditiously dropping it into water 14 from a boat or low flying aircraft. Platform 24 has several sealed compartments 28 that each can contain electrically interconnected control electronics 29, valve-controlled pressurized gas cylinders 30, a power supply 31 or an acoustic modem/cabled command signal receiver 32. Control electronics 29 receive command inflate and deflate signals from receiver 32 that receives signals indicative of a sensed intruding boat 20 from a barrier controller 33 that may include a percipient observer sending indicative signals over lead 34. Control electronics 29 generate inflation command signals for pressurized gas source 30 and/or deployment command signals for winch 35 to inflate body member 22 and pay-out cables 36 and 38 for rapid ascent of inflated body member 22. Other appropriate deflation command signals and retrieval command signals can be generated by electronics 29 for deflating valve 40 on inflatable barrier body member 22 and winch 35 to deflate and reel-in deflated body member 22 when needed. Control electronics 29 can be programmed to incorporate several "rules of engagement" options, including automatic inflate and/or deflate of body member 22 and deploy/retrieve cables 36 and 38 based on set cues of sensors of barrier controller 33 or requirements of manual confirmations/authorizations to fire (inflate) and/or deflate. Pressurized gas cylinders 30 can contain pressurized air or any of a number of other gases and can have external fittings (not shown) for manual recharging of the gas or air supply as required. Alternately, gas cylinders 30 could be connected via power umbilical and high pressure hoses in selected configurations to a distant floating platform or dock having a generator/air compressor and autonomous or automatic replenishment features could be added. Power supply 31 provides power for the control electronics 29, acoustic modem and cable signal receiver 32, actuators for valves 40 and 46 and winch 35. Connection for external power applied via a submerged cable is also provided, both to power the system externally and recharge the batteries of power supply 31.

Remotely located barrier controller 33 is placed in the expected path of an expected intruding boat 20. Barrier controller 33 can include an acoustic target detection sensing device known as the US NAVY TDD Mk 71 which can be upgraded to autonomously detect, classify, and localize targeted boats 20 that would be within range of inflatable barrier system 10 of the invention and to generate sensed signals indicative of the intruding boat 20. Barrier controller 33 also has remotely extending lead 34 to allow a remote observer or other sensor systems or control computers to selectively activate and/or augment the signal gathering capability of controller 33 to deploy or retract inflatable barrier system 10 as needed. Barrier controller 33 and the observer provide the appropriate indicative signals for receiver and control electronics 32 and 29 to initiate suitable components that assure the effectiveness of inflatable barrier system 10. Acoustic modem/cable line receiver 32 accepts the external sensed indicative signals for initiating selective inflation and deflation of body member 22 from barrier controller 33 via insulated wire 39 which is connected to receiver 32.

Sealed motor driven winch 35 is mounted on barrier support platform 24 and is responsive to deploy and retrieve body member 22 in response to command signals from electronics 29. When barrier controller 33 provides signals that may represent an intruding boat 20 and feeds these signals to control electronics 29 via acoustic-modem/signal-receiver 32, command signals are generated to inflate, release and deploy inflatable barrier body member 22. Compressed gas is fed to body member 22 via high pressure passageway 48 and one-way valve 46 and winch 35 begins to unreel fore and aft restraint cables 36 and 38 so that the now buoyant inflated body member 22 rapidly rises to surface 12 to intercept boat 20. At an appropriate later time, a deflation control signal from barrier controller/lead 33/34 is sent to control electronics 29 via signal receiver 32, causing deflating valve 40 to open and vent pressurized gas from body member 22. The venting of pressurized gas causes body member 22 to deflate as winch 35 reels cables 36 and 38 back in to re-locate the deflated barrier body member 22 on support platform 24 as shown in FIG. 1 for a subsequent operational cycle when desired.

Figure 2:
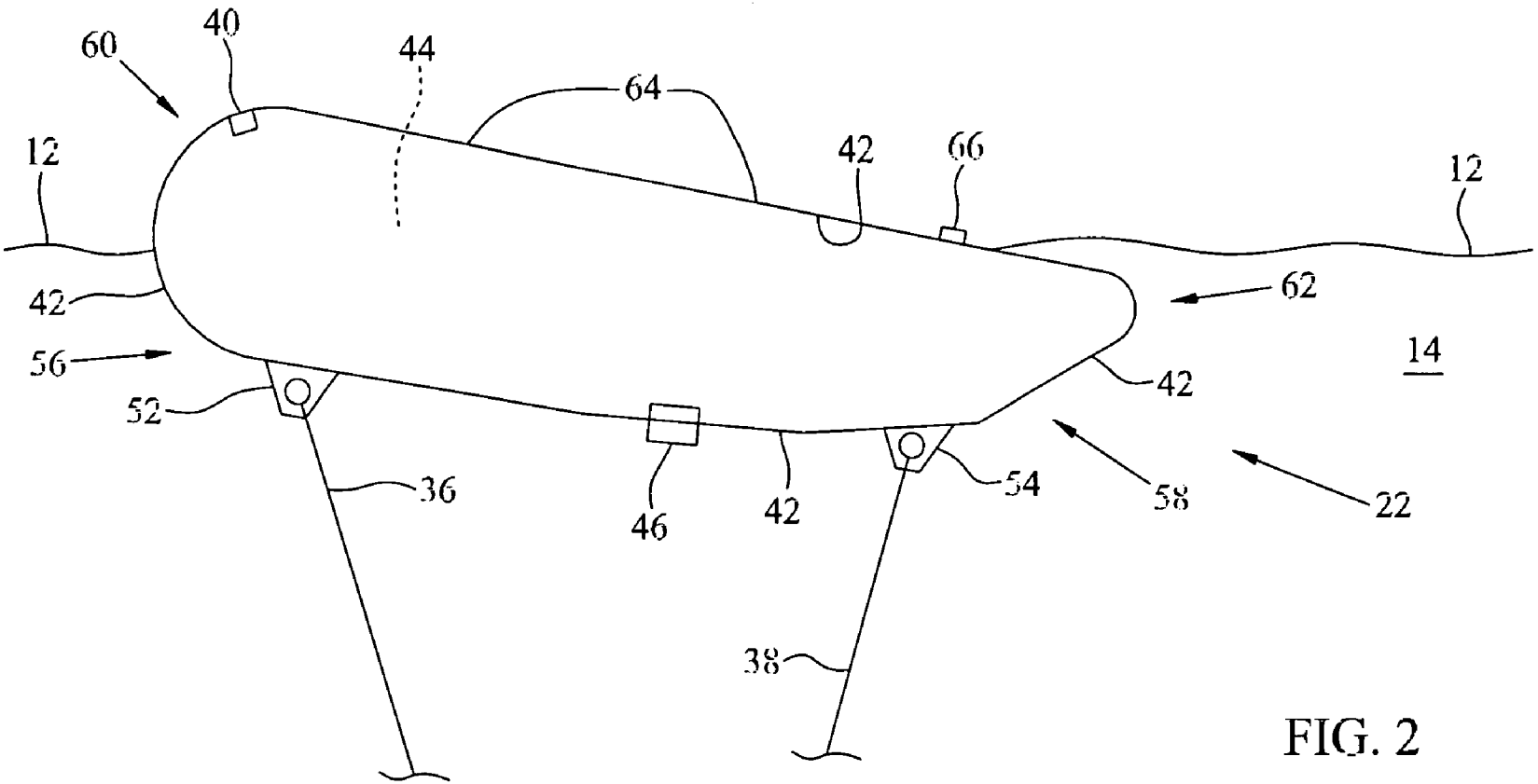
FIG. 2 is a schematic side view of the inflatable barrier body member of the inflatable barrier system deployed at the water/air interface.
Figure 4:
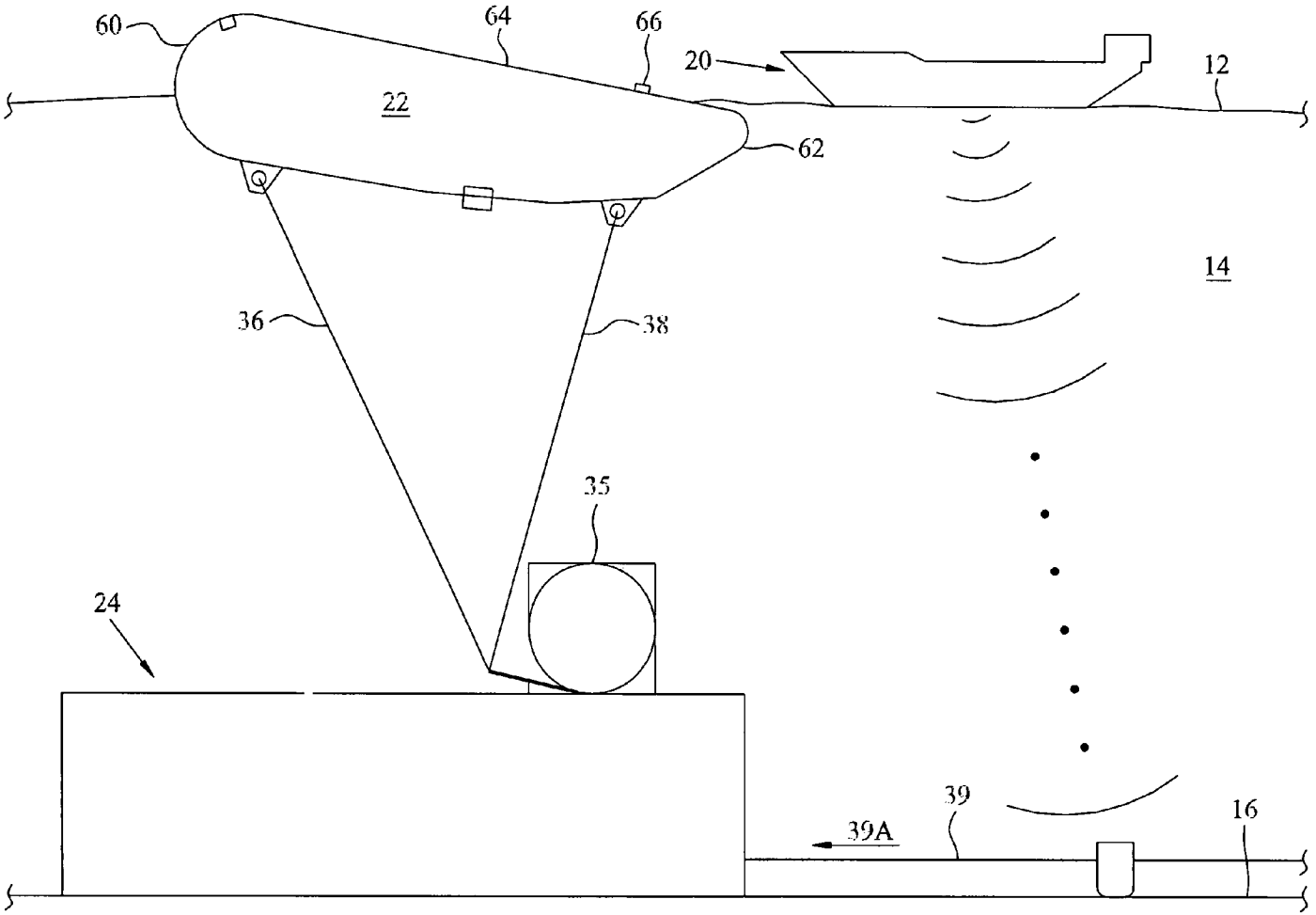
FIG. 4 is a schematic side view of the inflatable barrier system of the invention showing the rapidly inflated barrier body member at the water/air interface after it has been quickly inflated and shortly before impact by the intruding boat.
Figure 5:
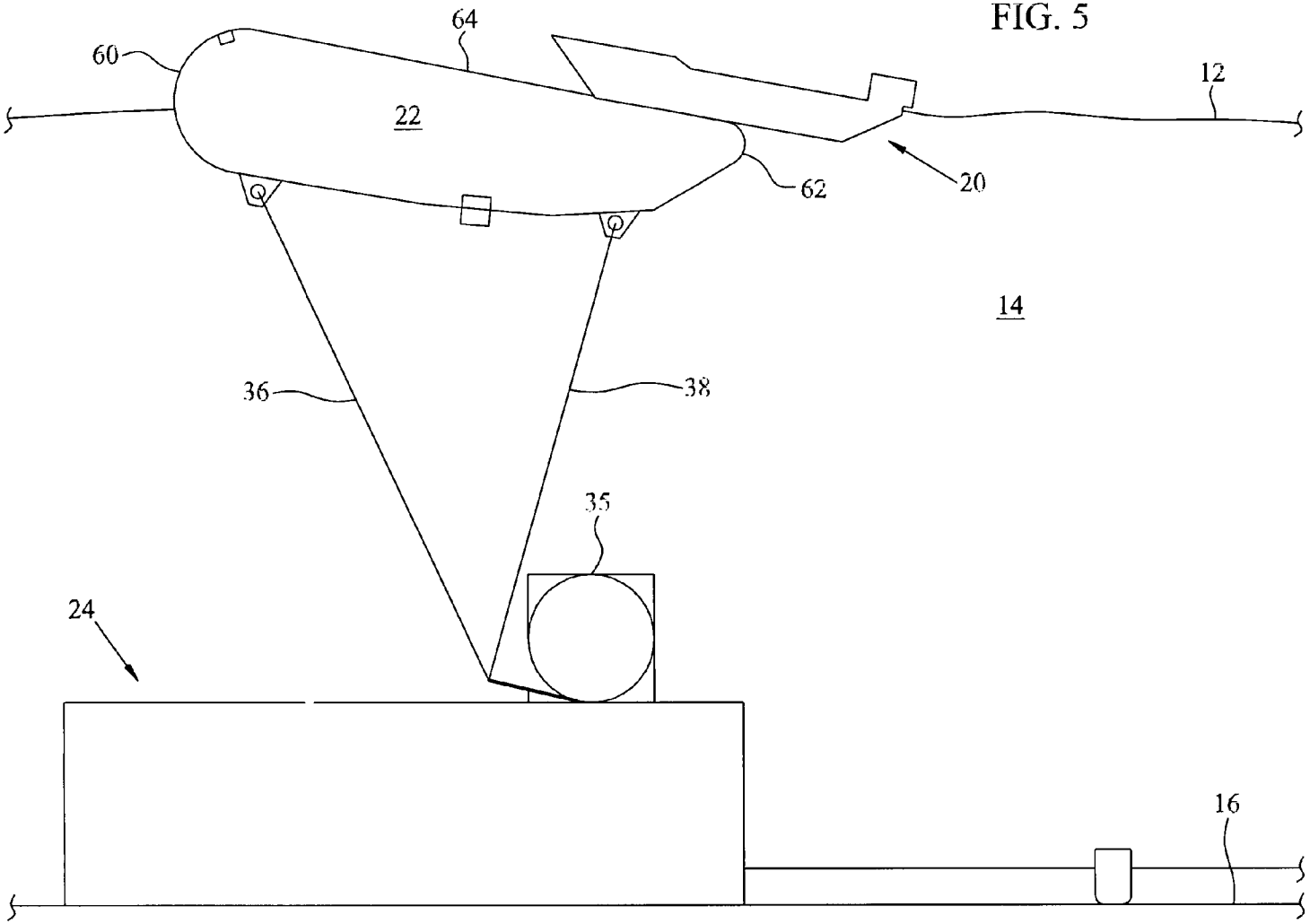
FIG. 5 shows the inflated barrier body member at the water surface and the boat riding up and being arrested and retained from further motion on the topside surface layer of the inflated barrier body member.

Referring also to FIG. 2, inflatable barrier body member 22 has tough flexible walls 42 enclosing an inflatable chamber 44. When the chamber 44 is inflated, body member 22 preferably takes the form of a wedge-shaped structure with the narrow side 58 of the wedge facing in the direction from which an intruding boat 20 would be expected, as shown in FIGS. 4 and 5. The flexible walls 42 of body member 22 can be fabricated from a heavy-duty laminate structure made from one or more different heavy-duty fabrics having man-made and/or natural interwoven fibers and/or including metallic filament-like strength members. The interwoven heavy-duty fabrics are impregnated with a strong, tough flexible adhesive bonding composite to form a flexible matrix that may include stays and other tough, flexible reinforcing members for additional strength and resistance to scuffing and tearing. Suitable fabrics and flexible bonding adhesives fabricated as a heavy duty laminate structures for flexible walls 42 of inflatable body member 22 are well known in the art.

The bottom part of flexible walls 42 of inflatable body member 22 has a one-way inflation valve fitting 46 coupled to receive and pass pressurized gas from high pressure passageway 48 extending from pressurized gas cylinders 30 to inflatable chamber 44. When flexible body member 22 is inflated into a wedge-shape by pressurized gas from pressurized cylinders 30, inflation fitting 46 automatically detaches from passageway 48 and remains closed when body member 22 becomes filled and floats towards the surface 12.

Restraint cables 36 and 38 are respectively connected to heavy duty forward and rear mounting loops 52 and 54 on the forward and rearward portions 56 and 58 of inflatable barrier body member 22. The lengths of forward and aft cables 36 and 38 are maintained at specific relative lengths to orient the inflated body member 22 at surface 12 at an inclination referred to as the intercept attitude. This intercept attitude allows the buoyancy of body member 22 to place bow 60 of barrier member 22 above surface 12 of water 14 and allows stern 62 to be below surface 12 of water 14. In other words, this intercept attitude is created when cables 36 and 38 are properly extended by winch 35 to place inflated body member 22 at surface 12 of water 14 and the right amount of tensile force otherwise known as the proper deploying tensile force is exerted and maintained on cables 36 and 38 by winch 35 to allow buoyancy of member 22 to raise and retain bow 60 above and pull down stern 62 below surface 12. The relative lengths of and tensions on cables 36 and 38 on winch 35 can be maintained to assure that the intercept attitude is maintained irrespective of the depth of water. Consequently, inflatable barriers 10 of the invention can be kept in inventory and used when and where needed without requiring extensive tuning for the different operational depths.

When forward and aft restraint cables 36 and 38 are connected to inflatable barrier body member 22, the buoyancy of the inflated body member 22 can allow it to rise in a controlled fashion toward surface 12 of water 14 by unreeling controlled amounts of cables 36 and 38 from winch 35. Winch 35 can also be controlled by control electronics 29 to selectively reel-in lengths of cables 36 and 38 to bring inflated body member 22 down in water 14 when this action is required.

When inflatable barrier body member 22 is inflated, it is shaped into a wedge profile that can be drawn down into water 14 by applying the proper deploying tensile force in cables 36 and 38 by winch 35. A speeding approaching surface boat 20 can "ride up" onto its topside surface layer 64, effectively "beaching" or halting the forward progress of boat 20. Topside surface layer 64 is made of a thick, tough, rough-textured material having a very high friction coefficient. This material will arrest the forward progress of boat 20 and keep the hull of boat 20 from sliding backward off inflated body member 22, effectively keeping boat 20 from escaping. Topside surface 64 can also include a "broaching" sensor 66 which detects the impact of boat 20 on layer 64 and sends a signal back through cables 36 and 38 to control electronics 30 to issue a command signal to winch 35. Winch 35 can then unreel more of cables 36 and 38 to further raise boat 20 "higher and dryer" on barrier body member 22.

Figure 3:
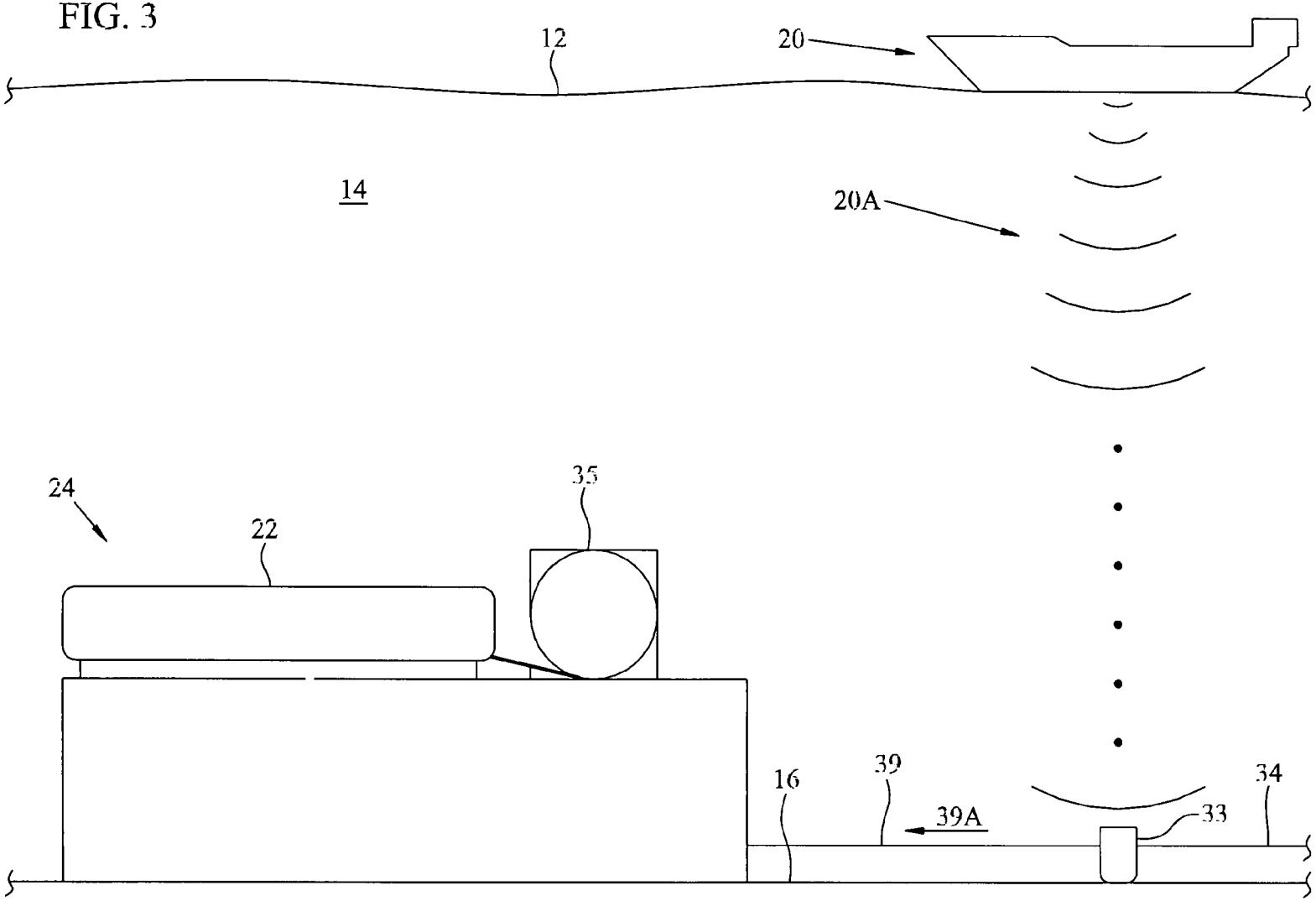
FIG. 3 is a schematic side view of the inflatable barrier system of the invention with the deflated barrier body member on the barrier support platform on the bottom of a body of water prior to deployment and the intruding boat being acoustically sensed by a typical sensor.

Referring also to FIGS. 3, 4, and 5, the operation of inflatable barrier system 10 of the invention may rely on a barrier controller 33 that senses and identifies the radiated acoustic signal 20A of an approaching, potentially hostile, boat 20 or other surface craft. At the appropriate time a command release/inflate signal 39A is generated and sent via a wire 39 or acoustic modem to barrier support platform 24 lying on bottom 16. Optionally, a percipient system operator might also be on station to observe intruding craft and initiate signal 39A over wire 39 via remotely extending lead 34. In either case components of support platform 24 described above are appropriately actuated to inflate barrier body member 22 which has been in the deflated condition on support platform 24, as shown in FIG. 3.

When release/inflate command 39A is received from barrier controller 33, at least one valve of pressurized gas cylinders 30 is opened by appropriate control signals from receiver 32 and control electronics 29 to release volumes of compressed gas through passageway 48 and one-way valve 46 and into inflatable chamber 44 in body member 22. The pressurized gases in chamber 44 rapidly inflate body member 22, which rises quickly to surface 12 of water body 14, see FIG. 4. The inflated barrier body is shaped to present a wedge-shaped barrier member 22 at the water-air interface at surface 12. This wedge-shaped barrier body member 22 has its bow 60 above surface 12 and its stern 62 below surface 12 and rises out of water in front of the approaching boat 20. The forward momentum of the speeding boat 20 causes it to "ride" up on topside surface layer 64 of inflated barrier body member 22 and essentially beaches itself on it, as shown in FIG. 5.

The creation and maintenance of the proper deploying tensile forces by winch 35 acting through restraint cables 36 and 38 at bow 60 and stern 62 of body member 22 assures the proper orientation of body member 22 so that boat 20 will ride up on it. Acceptable values for the proper deploying tensile forces can be pre-established in control electronics 29 and monitored by appropriate sensors at winch 35 so that power supply 31 feeds appropriate levels of power to winch 35 to create and maintain these forces in cables 36 and 38.

Since the surface material of topside surface 64 of inflated barrier body member 22 has a very rough texture with a high friction coefficient the "beached" boat 20 is kept from sliding back off body member 22 after it has been stopped. For some applications of inflatable barrier system 10, the topside surface of inflated barrier body member 22 can have different textures or no texture at all. The topside surface can also be made to include wires and projections to assure arresting of craft and/or topside surface can be smooth and/or have camouflaged coloration/fabrics and/or be non-reflective of impinging acoustic and/or radar energy to further improve the effectiveness of barrier 10.

Inflatable barrier system 10 including its inflatable barrier body member 22 is sized to the scale of the boats that it intends to intercept. A typical boat 20 intended to be stopped is relatively small, in the neighborhood of up to sixteen meters in length. If larger craft are anticipated, those skilled in the art having the teachings of this invention before them can scale inflatable barrier system 10 of the invention to provide an optimum effect for a specific range of boat sizes.

Inflatable barrier body member 22 and topside surface layer 64 may also have many filaments or other interfering structure that will wind on the propeller of boat 20 to arrest it or reduce the possibility of damage to body member 22 by the propeller. Alternatively, topside surface layer 64 can be strengthened with structured reinforcement filament/steel/Kevlar fibers to prevent damage to body member 22.

While a wedge shape of indeterminable depth has been described, one skilled in the art to which this invention pertains can design a barrier system based on this inventive concept to accommodate local considerations. This wedge shaped body member can be dimensioned to span channels or areas of considerable sizes. A number of anchored lines may have to be included to maintain the barrier-like capabilities of deeper and more elongated shapes for a barrier system. Accordingly, if desired, the shape of an inflatable body member and barrier support platform can be made more oblong, and may be oriented to present a larger cross section to enhance the likelihood of successful encounter. Orientation of body members on the surface of the water may be achieved by using a dual release from the submerged platform. An assisting jet-like mechanism or a small underwater rocket or propulsion mechanism can be used to accelerate and position the deployment of inflatable body members of the rapidly rising barrier.

Alignment of the bow and stern of an inflatable barrier body member with the orientation of a support platform on the bottom might be done by extending one of the restraint cables from the winch across the platform to a pulley and then up to either of the bow or stern with the other cable connected to the other one. The separated upward extending cables at the platform will have the same separation and orientation where they are connected at the floating body member so that the floating body member will be essentially in the same azimuth as the support platform. In addition, auxiliary lines connected to floating body members can extend to distant anchors to point them in the direction of possible intruding boats.

Figure 6:
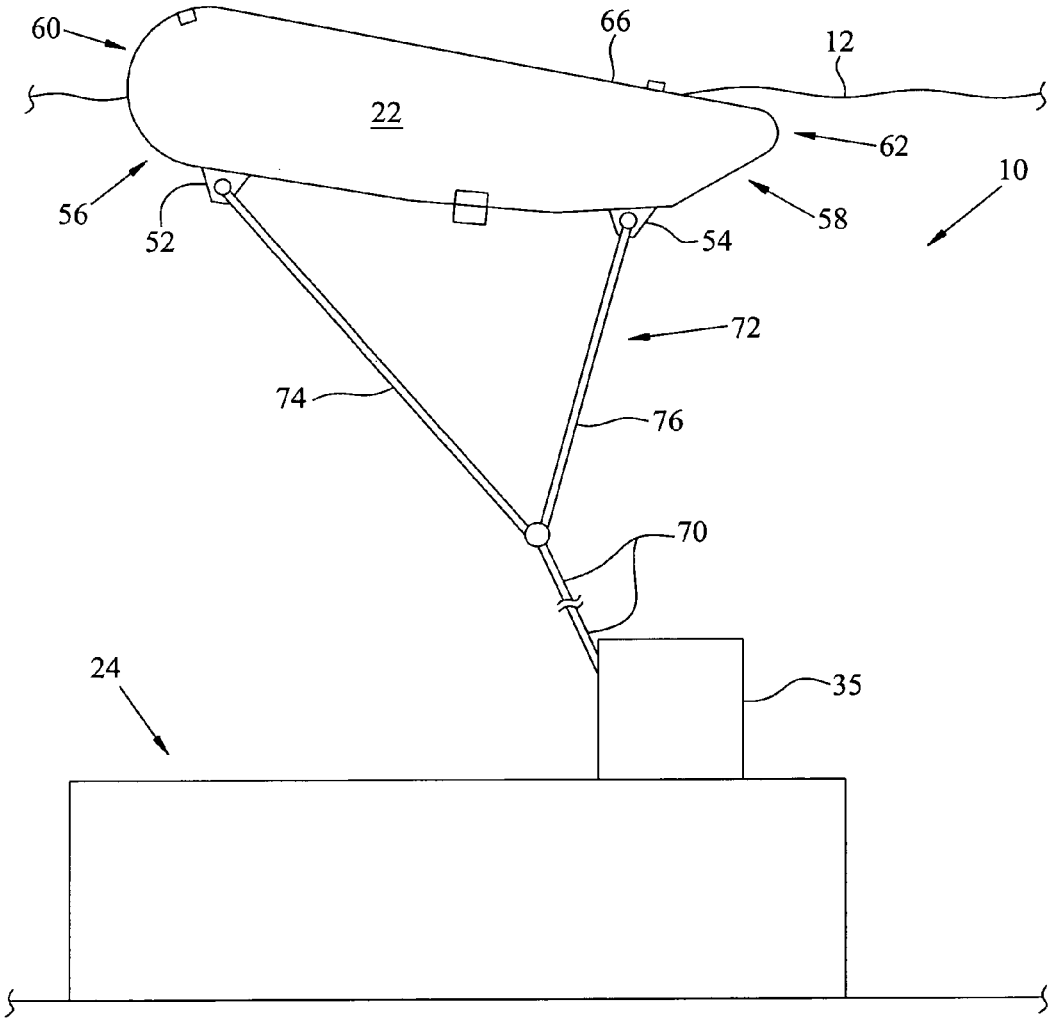
FIG. 6 is a schematic side view of another option for inflatable barrier system of the invention having only a single restraint cable extending to an inflatable barrier body member.

FIG. 6 shows an alternative arrangement for barrier system 10 of the invention. In this embodiment, only a single restraint cable 70 extends from winch 35 and is connected to a cable harness 72 having a pair of short cables 74 and 76. Short cables 74 and 76 are respectively connected to fore loop 52 and aft loop 54 at forward and aft portions 56 and 58 of inflatable barrier body member 22. The roughly Y-shaped cable harness 72 has short cables 74 and 76 specifically adjusted in length to transmit the proper deploying tensile force to inflatable barrier body member 22. This specific adjustment allows the buoyancy of inflatable barrier body member 22 to raise bow 60 and the forward part of topside surface layer 66 above water surface 12 and to hold stern 62 and rearward part of topside surface layer 66 below water surface 12 as the proper deploying tensile force is exerted by winch 35 through restraint cable 70 and harness 72. Having these teachings in mind other configurations and attachments of harness 72 will readily suggest themselves to one of ordinary skill in the art.

Inflatable barrier system 10 of the invention creates a relatively low impact on the vessel being stopped and its occupants, and minimizes permanent damage to the vessel and/or injury to the occupants. Also, inflatable barrier system 10 of the invention will preferably utilize a modular and open architecture that will allow for easy upgrading and optimization of barrier systems and targeted surface craft.

Modifications and alternate embodiments of inflatable barrier system 10 of the invention may be adapted, and differently configured to accommodate different security needs under different operational conditions. For example, inflatable body member 22 needs not be wedge-shaped as described but can be any of many other geometrical shapes so long as they are moored to extend a bow portion above surface 12 and a stern portion below surface 12 that creates a ramp-shaped structure rising out of water in front of the approaching surface craft or boat. Consequently, the forward momentum of the speeding craft causes it to ride up on topside surface of the inflated barrier body member 22 to essentially beach or broach itself on it.

The disclosed components and their arrangements as disclosed herein, all contribute to the novel features of this invention. It should be readily understood that many modifications and variations of the present invention are possible within the purview of the claimed invention. It is to be understood that within the scope of the appended claims the invention may be practiced otherwise than as specifically described.

We claim:

1. An inflatable barrier system for stopping an approaching boat on a body of water comprising:

a barrier support platform housing a source of pressurized gas and a power supply, and having an externally mounted winch connected to at least one cable extending therefrom;

an inflatable barrier body member having a bow and a stern, said body member being coupled to said pressurized gas source for inflation of said body member and said at least one cable being coupled to said bow and said stern of said body member for deployment of said body member at the surface of said water and to maintain said bow above said surface and said stern below said surface of said water when said body member is inflated; and a barrier controller providing signals indicative of an approaching boat to initiate inflation of said body member and deployment of said body member at said surface with said bow above said surface and said stern below said surface.

2. The inflatable barrier system of claim 1 further comprising:

an acoustic modem/signal receiver housed in said support platform being responsive to said signals indicative of an approaching boat; and control electronics housed in said support platform being responsive to said acoustic modem/signal receiver to actuate said gas source and said winch.

3. The inflatable barrier system of claim 2 wherein said body member is provided with an inflatable chamber, said body member being wedge-shaped upon inflation of said inflatable chamber by pressurized gas from said pressurized gas source.

4. The inflatable barrier system of claim 3 further comprising:

a deflating valve connected to said body member to allow selective deflation of said body member; and a one-way inflation valve fitting connected to said body member to receive and pass pressurized gas from said pressurized gas source to said inflatable chamber.

5. The inflatable barrier system of claim 4 wherein said winch has a pair of cables extending therefrom, said body member having one of said pair of cables connected to a loop on a forward portion of said body member and the other of said pair of cables being connected to a loop on a rearward portion of said body member for deployment of said inflated body member at the surface of said water and to maintain said bow above said surface and said stern below said surface.

6. The inflatable barrier system of claim 5 wherein said body member has flexible walls of heavy-duty laminate structure enclosing said inflatable chamber.

7. The inflatable barrier system of claim 6 further comprising:

a topside surface layer of thick, rough textured material on said body member, said topside surface layer having a very high friction coefficient to arrest the forward progress of a boat striking said body member when inflated, and to keep said boat from sliding backward off said body member.

8. The inflatable barrier system of claim 1 wherein said barrier controller includes an acoustic target detection sensing device, and said barrier controller provides said signals in response to the detection of an approaching boat by said sensing device.

9. The inflatable barrier system of claim 1, further comprising a remote actuation device coupled to said barrier controller and manually operable by a human observer.

10. The inflatable barrier system of claim 1 wherein said control electronics controls said power supply to provide appropriate levels of power to said winch and controls said winch to create and maintain proper deploying tensile forces to keep said bow above said surface and said stern below said surface of said water.

11. The inflatable barrier system of claim 7 further comprising a broaching sensor on said topside surface layer for detecting the impact of said boat on said topside surface layer.

12. An inflatable barrier system for stopping an approaching boat on a body of water comprising:

A barrier support platform housing a source of pressurized gas, and a power supply;

A winch mounted on said support platform and coupled to said power supply, said winch having at least two cables coupled to and extending therefrom;

An inflatable body member having a bow and stern, wherein said body member is coupled to said pressurized gas source, said bow is coupled to one of said cables, and said stern is coupled to another of said cables so that said bow is maintained above the surface of the water and said stern is maintained below the surface of the water when said body member is inflated and deployed;

Control electronics coupled to and capable of activating said pressurized gas source, said power supply, and said winch; and A barrier controller coupled to said control electronics and capable of activating same in response to a signal representative of an approaching boat;

Wherein said control electronics are configured to activate said pressurized gas source to inflate said body member and control said winch to pay out said cables to allow said body member to float to said surface in response to said signal from said barrier controller.

13. The inflatable barrier system of claim 12, wherein said signal representative of an approaching boat is generated by an acoustic target sensing device coupled to said barrier controller.

14. The inflatable barrier system of claim 12, wherein said signal representative of an approaching boat is generated by a remote trigger operable by a human operator, said remote trigger coupled to said barrier controller.

15. The inflatable barrier system of claim 12, wherein said inflatable barrier body member comprises:

An inflatable chamber having flexible walls of heavy-duty laminate structure, said chamber causing said body member to assume a wedge shape when said chamber is inflated;

A topside surface layer of thick, rough-textured material with a high friction coefficient;

A one-way inflation valve coupled to said pressurized gas source when said body member is stowed on said platform; and A deflating valve coupled to said control electronics for selective deflation of said body member.

16. The inflatable barrier system of claim 15, further comprising a broaching sensor mounted on said topside surface layer and coupled to said control electronics, wherein said control electronics activate the winch to pay out more of said cables when said control electronics receive a signal from said broaching sensor when said approaching boat impacts said body member.

* * * * *